US005853814A

United States Patent [19]

Murphy

[11] Patent Number: 5,853,814

[45] Date of Patent: Dec. 29, 1998

[54] PROCESS FOR FOAM TREATING PILE FABRICS

[75] Inventor: Peter Michael Murphy, Ooltewah, Tenn.

[73] Assignee: E. I. du Pont de Nemours and Company, Wilmington, Del.

[21] Appl. No.: 935,328

[22] Filed: Sep. 22, 1997

Related U.S. Application Data

[63] Continuation of Ser. No. 707,687, Sep. 4, 1996, abandoned.

[60] Provisional application No. 60/007,344 Nov. 20, 1995.

[51] Int. Cl.[6] ..... B05D 1/18; B05D 3/00; D06M 11/00

[52] U.S. Cl. ..... 427/434.6; 427/244; 427/248.1; 427/393.4; 427/373; 8/151; 8/158

[58] Field of Search ..... 427/393.4, 373, 427/244, 434.6, 248.1; 8/151, 158, 115.56, 115.65

[56] References Cited

U.S. PATENT DOCUMENTS

| | | | |
|---|---|---|---|
| 3,954,404 | 5/1976 | Childers et al. | 8/175 |
| 4,099,913 | 7/1978 | Walter et al. | 8/173 |
| 4,118,526 | 10/1978 | Gregorian et al. | 427/350 |
| 4,193,762 | 3/1980 | Namboodri | 8/14 |
| 4,275,683 | 6/1981 | Kutz et al. | 118/407 |
| 4,334,877 | 6/1982 | Gregorian et al. | 8/477 |
| 4,353,145 | 10/1982 | Woodford | 15/321 |
| 4,427,409 | 1/1984 | Gregorian et al. | 8/107 |
| 4,435,965 | 3/1984 | Sasseville et al. | 68/205 R |
| 4,463,583 | 8/1984 | Kruger et al. | 68/205 R |
| 4,576,112 | 3/1986 | Funger et al. | 116/415 |
| 4,908,149 | 3/1990 | Moore et al. | 252/139 |
| 5,074,883 | 12/1991 | Wang | 8/115.6 |
| 5,096,747 | 3/1992 | Scholla et al. | 427/299 |
| 5,219,620 | 6/1993 | Potter et al. | 427/434.2 |
| 5,223,340 | 6/1993 | Moss, III et al. | 428/395 |
| 5,346,567 | 9/1994 | Barnewall | 156/78 |
| 5,366,161 | 11/1994 | Potter et al. | 239/455 |
| 5,401,554 | 3/1995 | Armen | 428/96 |

FOREIGN PATENT DOCUMENTS

| | | | |
|---|---|---|---|
| 0 433 017 A | 6/1991 | European Pat. Off. . | |
| 41 30 432 A | 3/1993 | Germany . | |
| WO 91 02116 A | 2/1991 | WIPO . | |
| WO 93/05224 | 3/1993 | WIPO | D06B 19/00 |
| WO93/05224 | 3/1993 | WIPO | D06B 19/00 |

OTHER PUBLICATIONS

*Foam–Application Techniques,* Textile Progress, vol. 14, No. 2, pp. 16–34, 1986.

*Primary Examiner*—Shrive Beck
*Assistant Examiner*—Michael Barr

[57] ABSTRACT

An improved process for applying a treating agent in the form of a foam to fibrous material wherein the improvement comprises applying foam having a blow ratio of from about 2:1 to about 6:1 using equipment designed for the application of liquid treating agents is disclosed.

8 Claims, No Drawings

PROCESS FOR FOAM TREATING PILE FABRICS

This is a continuation of application Ser. No. 08/707,687 filed Sep. 4, 1996, now abandoned.

This Application claims the benefit of U.S. Provisional Application No. 60/007,344, filed Nov. 20, 1995.

FIELD OF THE INVENTION

The present invention provides a process for foam treating pile fabrics, in particular, floor coverings such as carpets. The invention provides a process for foam application of various treating agents using equipment conventionally used for liquid application of such agents.

BACKGROUND OF THE INVENTION

The application of foam or foam compositions to carpet is well known. Such foams contain chemical treating agents such as dyes, antistatics, stain resist agents, fluorochemicals, and mixtures thereof. Various types of equipment are used to apply foams to carpets. See, for example, U.S. Pat. No. 4,576,112 of Funger et al. disclosing equipment for application of foams to the face of carpets with a resilient seal pressed against the backing of the carpet to promote sealing. U.S. Pat. No. 5,366,161 of Potter et al. teaches equipment for application of foam through the backing of carpet using a blow ratio of 15:1 to 60:1. The techniques using this equipment are considered improvements over earlier methods involving casting foam onto one or both sides of a carpet which is then calendered into the surface by rolls or other pressure application means.

An alternative method for application of treating agents involves liquid application at very high wet pick-up levels (the ratio of the weight of the liquid applied to the dry weight of the carpet ×100). Currently the most effective equipment used for applying liquid agents, such as stain resists, is the Flexnip produced by Edward Küsters Machinenfabrik, Gladbacher Strasse, Krefeld, Germany. Treating agents applied with this equipment are distributed throughout the carpet by raising wet pick-up levels to the point where excessive fluid is used. However, this process uses excessive amounts of energy and water, and requires extracting stain resist agents before the carpet is dried.

A third alternative is to apply the treating agents by spraying the agents onto the face of the carpet after the washing and extraction steps. This method can result in uneven distribution of the chemicals through the carpet, and concentration of the chemicals along the upper portion of the carpet tufts. Thus chemicals can be lost in the shearing step during final finishing of cut pile carpets.

There is a need to develop an improved process for adding treating agents to carpets which requires less water and energy, reduces effluent streams, and improves the uniformity of the chemical application. Foam application at low wet pick-up levels offers the best approach. However, to achieve the desired results, special equipment for application of foams as noted above is required. For those currently using a liquid application process, the equipment for foam application represents an expensive investment. Thus a more economical process for application of treating agents by foam is needed. The present invention provides a process for foam application of treating agents to pile fabrics such as carpets by using conventional liquid application equipment, thereby eliminating the need for equipment particular to foam applications.

SUMMARY OF THE INVENTION

The present invention comprises an improved process for applying a treating agent in the form of foam to fibrous materials wherein the improvement comprises applying foam having a blow ratio of from about 2:1 to about 6:1 using equipment designed for the application of liquid treating agents.

DETAILED DESCRIPTION OF THE INVENTION

The present invention relates to a process for the foam treatment of fibrous materials such as floor coverings, in particular nylon carpets, using conventional equipment designed for liquid applications. The process involves the use of a foam having a blow ratio of about 2:1 to about 6:1, preferably 3:1 to 5:1. Such blow ratios are much lower than foams conventionally used in foam application equipment. The present invention teaches (a) the methods used to prepare such low blow ratio foams with adequate stability, (b) the method of application using conventional equipment designed for liquid application, (c) the drying and curing processes required, and (d) the tests utilized to demonstrate effective application, curing, and drying.

The use of very low blow ratio foams in equipment designed for liquid application results in economic, low energy requirements for drying, and uniformity of treatment advantages associated with foam application. The utilization of existing conventional liquid application equipment requires only minimal adaptation compared with the very high cost of foam application equipment. Additionally the costs of maintaining and operating dedicated foam application equipment are eliminated.

The blow ratio of a foam is defined as the ratio of the weight of the bath liquid to the weight of an equal volume of foam prepared from the bath liquid. The foam density in g/ml is approximately equal to the reciprocal of the blow ratio, thus a foam density of 0.2 g/ml corresponds to a blow ratio of 5:1. The stability of a foam is typically measured in terms of its half-life, the time required for the weight of a freshly-prepared foam sample to decrease to half its original weight due to liquid draining from the foam and forming a lower liquid layer. A suitable half life for the purposes of this invention is from about 2 to about 10 minutes, preferably from about 3 to about 5 minutes. More preferable is a minimum half life equal to or greater than 3 minutes. Test Method 3 (below) describes the measurement of foam density, blow ratio, and foam stability.

Conventional high blow ratio foams, e.g., foams with blow ratios significantly higher than the 2:1 to 6:1 range of this invention, have relatively stiff foam characteristics and, when applied using conventional equipment designed for liquid application, do not adequately wick, wet, and penetrate the carpet fiber as needed for complete and uniform application. The low blow ratio foams of this invention, however, flow readily and penetrate and wet the carpet fiber thoroughly and uniformly. Wet pick up ratios of from about 50% to about 150% are employed.

Low blow ratio, high density foams as used in this invention are best prepared using a dynamic foam generator. While several dynamic foam generators are available, an example of a dynamic foam generator design would be a mechanical mixer comprising essentially a canister containing an internal rotating cylinder. The cylinder and canister have attached a series of metal pins radially aligned to provide high shearing action to the air and solution fed to the foam generator as the cylinder is rotated.

Manufacturers of such dynamic foam generating equipment include Latex Equipment Sales & Service (Dalton, Ga.), Dalton Industrial Systems (Dalton, Ga.), and Datacolor International (Atlanta, Ga.). These manufacturers provide information on dynamic foamer operation and process control. Such foam generators are typically built to custom specifications which match specific process requirements.

Another foam generator design is the static foam generator. Static foam generators generate foams by flowing air and the surfactant-containing bath solution to be foamed through a packed column. Packing material examples are glass beads, ball bearings, metal turnings or steel wool, and like materials. Static foam generators were found to be less effective in producing the low blow ratio, high stability foams of this invention. Thus dynamic foam generators are greatly preferred.

The process of the present invention is useful for application of various treating agents to pile fabrics. Included for example are dyes, antistatics, stain resist agents, and various fluorochemicals. In the case of a stain resist agent, the stain resist solution (conventionally termed the stain resist bath) is prepared with conventional surfactants at the required concentration and pH, and foamed using a dynamic foam generator, as described above. The pH range is from about 1.5 to about 2.5, and preferably from about 1.7 to about 2.0. The pH may be adjusted with any strong acid, including sulfuric, phosphoric, and sulfamic acids. Preferred acidifying agents are those formulated to minimize equipment corrosion and handling hazards, such as Autoacid AA10 (Peach State Labs, Rome, Ga., a proprietary formulation based on U.S. Pat. No. 5,234,466). The stain resists useful in the present invention are those well known to those skilled in the art, and include "ZELAN 300" (a stain resist formulation prepared according to U.S. Pat. No. 4,883,839 and 4,948,650, and available from E. I. DuPont du Nemours and Company, Wilmington, Del.), phenolic and/or novolac resins (available from Ciba Corporation, Greensboro N.C. and Crompton & Knowles, Charlotte, N.C.), polymers or copolymers of maleic acid (available from E. I. DuPont du Nemours and Company, Wilmington, Del.), polymers or copolymers of methacrylic acid (available from 3M Company, Minneapolis, Minn.) phenyl vinyl ether polymers or copolymers (available from Allied Signal, Morristown, N.J.), polymers of sulfonated fatty acids (available from Interface Corp., LaGrange, Ga.), sulfonated fatty acids, phenolic-formaldehyde polymers, and blends of these stain resists. The preceding commercial suppliers are provided as examples, and other sources are well known to those skilled in the art.

The bath concentration and wet pick up are adjusted to apply the foam in an amount sufficient to give a concentration of from about 0.2% to about 2.0%, and preferably 0.5% to 1.0%, of the stain resist active ingredient based on the weight of the dried carpet fiber, or at the level recommended by the stain resist supplier. In the case of Küsters' "FLEXNIP" equipment (Zima Corporation, Spartanburg, S.C. described further below), for instance, the wet pick up for liquid application is typically 250% to 300%. Using a 3:1 blow ratio foam instead of liquid, the wet pick up will be one third as much, or about 80% to about 100%.

Surfactants suitable for use in the stain resist bath are also well known to those skilled in the art. The surfactants are typically anionic and include "CALSOFT AOS-40 " (40% aqueous solution of the sodium salts of sulfonated $C_{14-16}$ alkanes and alkenes, from Pilot Chemical Co., Avenel N.J.), Rohm & Haas "DOSS" (50% aqueous solution of di-2-ethylhexyl sodium sulfosuccinate from Rohm & Haas Co., Philadelphia Pa.), "KAF 300S" (a proprietary blend of anionic surfactants and hydrotrope from Peach State Labs, Rome, Ga.), "DOWFAX 2A1" (a mixture of docecyl-(sulfophenoxy) benzenesulfonic acid and oxybis-(dodecylbenzenesulfonic acid) disodium salts from Dow Chemical Company, Midland, Mich.) and "DOWFAX 2A4" (benzene, 1,1-oxybis, tetrapropylene derivatives, sulfonated, sodium salts from Dow Chemical Company, Midland, Mich.).

Typically the stain resist formulation as purchased already contains some surfactant to wet the fibers, and which also can act as a foaming agent. To make the low blow ratio foams of this invention, additional anionic surfactant or foaming agent in an amount sufficient to yield stable foams is added to the bath, typically in amounts of from about 1 to about 5 g/L, and preferably from about 2 to about 3 g/L. Some bath factors may negatively affect foam quality, for instance salts, temperature, water hardness, and contaminants such as oil. In such cases, a higher surfactant concentration as necessary to provide the required foam blow ratio and stability is substituted.

The foams used in this invention have half-lives from about 2 to about 10 minutes, preferably from about 3 to about 5 minutes, and blow ratios of from about 2:1 to about 6:1, and preferably 3:1 to 5:1, as measured by Test Method 3, described below. Such half-lives and blow ratios are properties that permit even distribution and thorough penetration of the foam into the carpet fibers.

The foam is applied to the pile fabric using any conventional liquid application equipment having a manifold designed to deliver a high wet pick up and to distribute the liquid evenly to the fabric. An example of such conventional equipment is the Küsters' "FLEXNIP" equipment. The Küsters' "FLEXNIP" was introduced in 1987 for continuous application of stain resist chemicals after dyeing and prior to drying. In the "FLEXNIP", the carpet passes vertically through a very small chemical bath with the wet pick up being controlled by the opposing pressurized air bellows at the bottom of the bath. The carpet then enters a post-steamer followed by a vacuum extractor. The stain resist chemical bath is delivered to the "FLEXNIP" by a series of tubes spaced evenly between 2 to 6 inches (5–15 cm) apart on both the face and the backing sides of the moving carpet.

The typical configuration of the liquid feed module for a conventional liquid application equipment comprises essentially a liquid storage tank for the bath solution and a pump that supplies the liquid bath to the liquid feed manifold. The only adaptations required for use of such equipment in the process of this invention are the connection of a dynamic foam generator in line between the existing pump and manifold, and the supply of a regulated air supply to the dynamic foam generator.

Other appropriate equipment for the liquid application of stain resist or other treating agents using the low blow ratio foam process of this invention is manufactured by companies such as Fleissner (Charlotte, N.C.), Latex Equipment Sales & Service (Dalton, Ga.), Dalton Industrial Systems (Dalton, Ga.), Datacolor International (Atlanta, Ga.), and Gaston County Carpet Machinery Corporation (Fort Oglethorpe, Ga.).

After passing through the liquid application equipment, the fabric is steamed, vacuum extracted, and oven dried and cured. Steam temperatures and times are well know to those skilled in the art, typically near 210° F. (99° C.) and 60 to 120 seconds. Oven temperatures are those sufficient to dry the carpet or as recommended by the stain resist supplier, typically about 270° F. (132° C.) for about 60 seconds. Samples of treated fabric are tested using the Stain Resistance Test Method 1 before and after the alkaline surfactant wash described in the Shampoo Test Method 2. Test Methods are described hereinafter.

The foam application process for treating agents of this invention are readily integrated with other carpet manufacturing operations; examples of such other operations are dyeing and fluorocarbon soil resist application. An integrated operation could include the sequence dyeing, steaming, wash/rinse, vacuum extraction, stain resist application, steaming, wash/rinse, vacuum extraction, soil resist application, drying and curing. Techniques for integrating such processes are well know to those skilled in the art.

TEST METHODS

Test Method 1

Stain Resistance Test

Acid dye stain resistance was evaluated using a modified procedure based on the American Association of Textile Chemists and Colorists (AATCC) Method 175-1991, "Stain Resistance: Pile Floor Coverings". A staining solution was prepared by mixing cherry-flavored "KOOL-AID" powder (from Kraft/General Foods, White Plains N.Y., a powdered drink mix sold under the trademark "KOOL-AID" sweetened with sugar and containing, inter alia, FD&C Red No. 40) with water according to the preparation instructions on the "KOOL-AID" container. The carpet sample to be tested was placed on a flat non-absorbent surface and a hollow plastic cylinder having a 2 inch (5.1 cm) diameter was placed tightly over the carpet sample. Twenty ml of the "KOOL-AID" staining solution was poured into the cylinder and the solution was allowed to absorb completely into the carpet sample. The cylinder was then removed and the stained carpet sample was allowed to sit undisturbed for 24 hours, after which it was rinsed thoroughly under cold tap water, squeezed, and oven dried at 150° F. (66° C.).

The carpet sample was then visually inspected and rated for staining according to the FD&C Red No. 40 Stain Scale described in AATCC Method 175-1991. A stain rating of 10 is excellent, showing outstanding stain resistance, whereas 1 is the poorest rating, comparable to an untreated control sample.

Test Method 2

Shampoo Test (Wash Durability)

The carpet specimen was submerged for 5 minutes at room temperature in a detergent solution consisting of "DUPONOL WAQE" (2.0 oz. per gal., 15 g/L). "DUPONOL WAQE" is a 30–40% aqueous solution of sodium alkane sulfonates, available from Witco Corporation, Greenwich, Conn.). The solution was adjusted with dilute sodium carbonate to a pH of 10. The specimen was then removed, rinsed thoroughly under tap water, de-watered by squeezing, and oven dried at 150° F. (66° C.) The dry carpet specimen was then tested according to Test Method 1, as described above.

Test Method 3

Foam Blow Ratio and Stability Measurement

A foam sample from the foam generator was placed in a weighed graduated cylinder, the foam weight was determined by difference and the foam volume measured to determine the foam density. For typical bath solutions having a density of about 1 g/ml, the blow ratio was the reciprocal of the foam density. Using a stopwatch, the separation of liquid from the foam was observed as the appearance of a liquid layer in the bottom of the cylinder. The time required for the volume of the liquid layer corresponding to half the weight of the initial foam was observed and is the half-life of the foam. If the unfoamed bath density was significantly different from 1 g/ml, the blow ratio and separated liquid volume were calculated accordingly. Other equivalent techniques can be substituted, for instance by filling a weighed separatory funnel of known volume with foam, reweighing, then allowing the separated liquid to drain into a tared container on a balance.

EXAMPLES

Example 1

A dyed residential cut-pile carpet, 40 oz./sq. yd. (1355 g/m$^2$) produced by a conventional mill process and composed of nylon-6,6 bulk continuous fiber (BCF) face fiber and polypropylene primary backing) was passed though a K üsters' "FLEXNIP" liquid application equipment, with the application manifold adapted to feed a low blow ratio foam by inserting a dynamic foam generator equipped with a regulated air supply between the pump supplying bath liquid to the application manifold and the application manifold inlet. The Dalton laboratory dynamic foamer and regulator used comprised a dynamic foamer —electric motor (Model # 5BPB56SAA200, General Electric, Schenectady, N.Y.) with a canister (4 liter dynamic frother, Latex Equipment Sales & Service, Dalton, Ga.) with air supply from a Dixon model # DB12-221-M3LA air regulator (Dixon Valve & Coupling Company, Chestertown, Md.).

The stain resist bath contained 45 g/L of "ZELAN 300", (E.I. du Pont de Nemours & Company) 2 g/L of "CALSOFT AOS", (Pilot Chemical Co., Avenel, N.J.) and the pH was adjusted to 1.7 with "AUTOACID AA10" (Peach State Labs, Rome, Ga.). The bath solution was pumped to the dynamic foam generator and fed to the "FLEXNIP" application manifold at a rate sufficient to provide 0.95% "ZELAN 300" active ingredient based on the weight of the dried fiber. After passing through the "FLEXNIP" using a bellows (or bladder) pressure of 7 psi (48.3×10$^3$ Pa), the carpet was steamed at 270° F. (132° C.) for 70 seconds, vacuum extracted, and oven dried/cured. The stain resistance was tested by Test Method 1. The shampoo resistance was measured by Test Method 2. The test results for Example 1 are shown in Table 1.

Examples 2–4

Examples 2–4 were prepared as for Example 1, but with the varied surfactant, surfactant concentration, and blow ratio, as shown in Table 1. The test results for Examples 2–4 are shown in Table 1.

TABLE 1

| Ex. # | ZELAN 300 %[a] | Surfactant Type[b] | Blow Ratio | Steam Time (sec) | Steam Temp. (F.)[c] | Bladder Press. (psi)[d] | Staining Test Results: Average Result, Test Method 1 | Average Result, Test Method 2 | Best Result, Test Method 1 | Best Result, Test Method 2 |
|---|---|---|---|---|---|---|---|---|---|---|
| 1 | 0.95 | AOS | 3:1 | 70 | 210 | 7 | 9.5 | 4 | 10 | 5 |
| 2 | 0.84 | DOSS | 5:1 | 120 | 210 | 7 | 8 | 2 | 9 | 2 |
| 3 | 0.84 | AOS | 4.5:1 | 120 | 210 | 7 | 9 | 2.5 | 10 | 3 |
| 4 | 0.84 | AOS | 4:1 | 80 | 210 | 7 | 9 | 3 | 10 | 4 |

[a]ZELAN 300 % is as active ingredient based on the dried carpet fiber weight. The active ingredient level in ZELAN 300 as supplied is 21%

[b]AOS is "CALSOFT AOS" from Pilot Chemical Co., Avenel, New Jersey. "DOSS" is from Rohn & Haas Co., Philadelphia, Pennsylvania.

[c]210° F. = 99° C.

[d]7 psi = 48.3 × $10^3$ Pa

No industry-wide standards exist for acceptable stain resist performance. Typical results obtained using liquid application equipment between 250% to 300% wet pick up are 9 or 10 for test method #1 and 5 to 7 for test method #2. The results of test method #2 are a measure of the durability of the stain resist treatment to a repeated carpet cleanings. The stain resist performance after repeated carpet cleanings is generally poorer than the carpet's original performance but better than carpet which has not been treated with a stain resist agent.

What is claimed is:

1. A process comprising applying a treating agent in the form of a foam to fibrous material said foam having a half life of from about 2 to about 5 minutes and a blow ratio of from about 2:1 to about 6:1 at a wet pick up of from about 80% to about 150% using liquid application equipment wherein said material is passed through a chemical bath containing the treating agent.

2. The process of claim 1 wherein the fibrous material is a floor covering.

3. The process of claim 2 wherein the floor covering is nylon carpet.

4. The process of claim 1 wherein the foam has a minimum half life of about 3 minutes.

5. The process of claim 1 wherein the foam is generated using a dynamic foam generator.

6. The process of claim 1 wherein the treating agent contains a stain resist agent.

7. The process of claim 6 wherein the stain resist is selected from the group consisting of hydrolyzed polymers or copolymers of maleic anhydride, polymers or copolymers of methacrylic acid, phenolic-formaldehyde polymers, sulfonated fatty acids, and polymers of sulfonated fatty acids.

8. The process of claim 1 further comprising steaming, vacuum extracting, drying and curing the fibrous material.

* * * * *